US010754278B2

(12) United States Patent
Fukunaga et al.

(10) Patent No.: US 10,754,278 B2
(45) Date of Patent: Aug. 25, 2020

(54) IMAGE FORMING APPARATUS WHICH CORRECTS TORQUE BASED ON TEMPERATURE OR CONVEYANCE SPEED AND PREDICTS A LIFE OF THE FIXER BASED ON A CORRECTED TORQUE

(71) Applicant: Konica Minolta, Inc., Tokyo (JP)

(72) Inventors: Masayuki Fukunaga, Nagareyama (JP); Toshiaki Tanaka, Toyokawa (JP); Masayuki Watanabe, Fuchu (JP); Mineo Yamamoto, Tokai (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/276,321

(22) Filed: Feb. 14, 2019

(65) Prior Publication Data

US 2019/0286022 A1 Sep. 19, 2019

(30) Foreign Application Priority Data

Mar. 13, 2018 (JP) ..... 2018-045482

(51) Int. Cl.
*G03G 15/20* (2006.01)
*G03G 15/00* (2006.01)

(52) U.S. Cl.
CPC ..... *G03G 15/2028* (2013.01); *G03G 15/2039* (2013.01); *G03G 15/5008* (2013.01); *G03G 15/5045* (2013.01); *G03G 15/55* (2013.01); *G03G 15/553* (2013.01); *G03G 2215/00746* (2013.01); *G03G 2215/00772* (2013.01); *G03G 2215/2045* (2013.01)

(58) Field of Classification Search
CPC ..... G03G 15/2028; G03G 15/2039; G03G 15/55; G03G 15/553; G03G 15/5008; G03G 15/5045; G03G 2215/00746; G03G 2215/00772; G03G 2215/2045
See application file for complete search history.

(56) References Cited

U.S. PATENT DOCUMENTS 9,395,669 B1 * 7/2016 Miyazaki ..... G03G 15/55
2013/0016986 A1 * 1/2013 Kim ..... G03G 15/5008 399/44
2014/0363185 A1 * 12/2014 Tamada ..... G03G 15/2028 399/68

FOREIGN PATENT DOCUMENTS

JP 2007309980 11/2007

* cited by examiner

*Primary Examiner* — Joseph S Wong
(74) *Attorney, Agent, or Firm* — Lucas & Mercanti, LLP

(57) ABSTRACT

An image forming apparatus including: a fixer that fixes a toner image formed on a recording medium by pressing and heating the recording medium nipped in a nip portion formed by causing two rotating bodies to pressedly abut on each other, and conveying the recording medium by rotating the rotating bodies; a motor that drives the rotating bodies by transmitting a torque to at least one of the rotating bodies; a torque detector that detects the torque transmitted to the rotating body by the motor; a temperature detector that detects temperature of the rotating body; a speed detector that detects a conveyance speed for conveying the recording medium by the fixer; and a controller that corrects the detected torque based on at least any one of the detected temperature and the detected conveyance speed and predicts a life of the fixer based on the corrected torque.

14 Claims, 16 Drawing Sheets

| | Torque | | Cause of change |
|---|---|---|---|
| | Decrease | Increase | |
| Conveyance speed | Slow | Fast | Accuracy in speed control of fixation motor |
| Fixing belt temperature | High | Low | Temperature control accuracy |
| Pressing roller temperature | High | Low | Fixer warming state |

FIG.13

| | | Conveyance speed [mm/s] | | | | |
|---|---|---|---|---|---|---|
| | | 100 | ··· | 220 | ··· | 300 |
| Fixing belt temperature [°C] | 100 | 1.01 | ··· | 0.74 | ··· | 0.56 |
| | 110 | 1.03 | ··· | 0.76 | ··· | 0.58 |
| | ⋮ | ⋮ | ⋮ | ⋮ | ⋮ | ⋮ |
| | 160 | 1.27 | ··· | 1.00 | ··· | 0.82 |

| | | Pressing roller temperature [°C] | | | | |
|---|---|---|---|---|---|---|
| | | 100 | 110 | ··· | 150 | 300 |
| Fixing belt temperature [°C] | 100 | 1.01 | ··· | ··· | ··· | 0.56 |
| | 110 | 1.03 | ··· | ··· | ··· | 0.58 |
| | ⋮ | ⋮ | ⋮ | ⋮ | ⋮ | ⋮ |
| | 160 | 1.27 | ··· | 1.00 | ··· | 0.82 |

IMAGE FORMING APPARATUS WHICH CORRECTS TORQUE BASED ON TEMPERATURE OR CONVEYANCE SPEED AND PREDICTS A LIFE OF THE FIXER BASED ON A CORRECTED TORQUE

CROSS-REFERENCE TO RELATED APPLICATION

The entire disclosure of Japanese patent application No. 2018-045482, filed on Mar. 13, 2018, is incorporated herein by reference in its entirety.

BACKGROUND

1. Technological Field

The present invention relates to an image forming apparatus and a non-transitory computer-readable storage medium storing a control program for the image forming apparatus.

2. Description of the Related Art

An electrophotographic image forming apparatus such as a copier, a printer, a facsimile, and an MFP (multifunction peripheral) which is an integrated machine of them is provided with a fixer for fixing a toner image. The fixer melts and fixes the toner image on a sheet by pressing and heating the sheet on which the toner image is formed in a nip portion.

In recent years, in order to achieve energy saving by reducing a heat capacity of the fixer, the nip portion is formed by causing a pressing roller to pressedly abut on a fixing belt suspended to a pad. In this configuration, the sheet nipped in the nip portion formed between the rotationally driven pressing roller and the rotating fixing belt rotating to follow the pressing roller is pressed and heated at the nip portion while it is conveyed.

However, in the aforementioned configuration, since the pad and the fixing belt slide each other, durability of the pad or the like is relatively degraded. In addition, it is necessary to predict a life of the fixer that may be failed due to abrasion of the pad or the like and notify a user to urge replacement before the fixer is failed.

A technique of predicting the life of the fixer is described in Unexamined Japanese Patent Publication No. 2007-309980. That is, a torque of a motor that rotationally drives rotating bodies used to form the nip portion is detected for a sheet non-passing period in the fixer, and the life is estimated from the detected torque.

SUMMARY

However, the torque for rotationally driving the rotating body used to form the nip portion changes depending on a temperature of the rotating body and a conveyance speed of the sheet. In the technique discussed in Unexamined Japanese Patent Publication No. 2007-309980, the life of the fixing device is estimated on the basis of the torque detected during the sheet non-passing period for which a temperature change is relatively small. However, the temperature of the rotating body changes, for example, depending on the thickness of the sheet or the like. The conveyance speed changes, for example, depending on accuracy of a speed control using the motor or the like. In the technique described in Unexamined Japanese Patent Publication No. 2007-309980, there exists a problem that it is necessary to wait for the sheet non-passing period in order to estimate the life of the fixing device. In addition, there exists a problem that it fails to consider degradation of accuracy in prediction of the life of the fixing device due to changes of the temperature and the conveyance speed of the rotating body.

The present invention has been made to address the aforementioned problems. Therefore, an object of the invention is to provide an image forming apparatus and a control program for the image forming apparatus, by which accuracy in prediction of the life of the fixer can be easily and efficiently improved.

To achieve at least one of the abovementioned objects, according to an aspect of the present invention, an image forming apparatus and a control program for the image forming apparatus reflecting one aspect of the present invention comprises the followings.

An image forming apparatus comprising: a fixer that fixes a toner image formed on a recording medium by pressing and heating said recording medium nipped in a nip portion formed by causing two rotating bodies to pressedly abut on each other, and conveying said recording medium by rotating said rotating bodies; a motor that rotationally drives said two rotating bodies by transmitting a torque to at least any one of said rotating bodies; a torque detector that detects said torque transmitted to said rotating body by said motor; a temperature detector that detects temperature of said rotating body; a speed detector that detects a conveyance speed for conveying said recording medium by said fixer; and a controller that corrects said detected torque on the basis of at least any one of said detected temperature and said detected conveyance speed and predicts a life of said fixer on the basis of a corrected torque.

A non-transitory computer-readable storage medium storing a control program for an image forming apparatus, said image forming apparatus comprising: a fixer that fixes a toner image formed on a recording medium by pressing and heating said recording medium nipped in a nip portion formed by causing two rotating bodies to pressedly abut on each other, and conveying said recording medium by rotating said rotating bodies; a motor that rotationally drives said two rotating bodies by transmitting a torque to at least any one of said rotating bodies; a torque detector that detects said torque transmitted to said rotating body by said motor; a temperature detector that detects temperature of said rotating body; and a speed detector that detects a conveyance speed for conveying said recording medium by said fixer, wherein said control program causing a computer to perform correcting said detected torque on the basis of at least any one of said detected temperature and said detected conveyance speed and predicting a life of said fixer on the basis of said corrected torque.

The objects, features, and characteristics of this invention other than those set forth above will become apparent from the description given herein below with reference to preferred embodiments illustrated in the accompanying drawings.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 12 is a diagram illustrating a relationship between a running distance and a detected torque after the torque starts to increase due to abrasion of the pad of the fixer or the like;

FIG. 13 is a diagram illustrating a table in which correction coefficients for correcting the detected torque to a torque under a reference condition are defined for each conveyance speed and each fixing belt temperature, and for each fixing belt temperature and each pressing roller temperature;

FIG. 14 is a diagram illustrating a relationship between the running distance and the detected torque before and after the torque correction after the torque starts to increase due to abrasion of the pad of the fixer or the like;

DETAILED DESCRIPTION OF EMBODIMENTS

Figure 1:
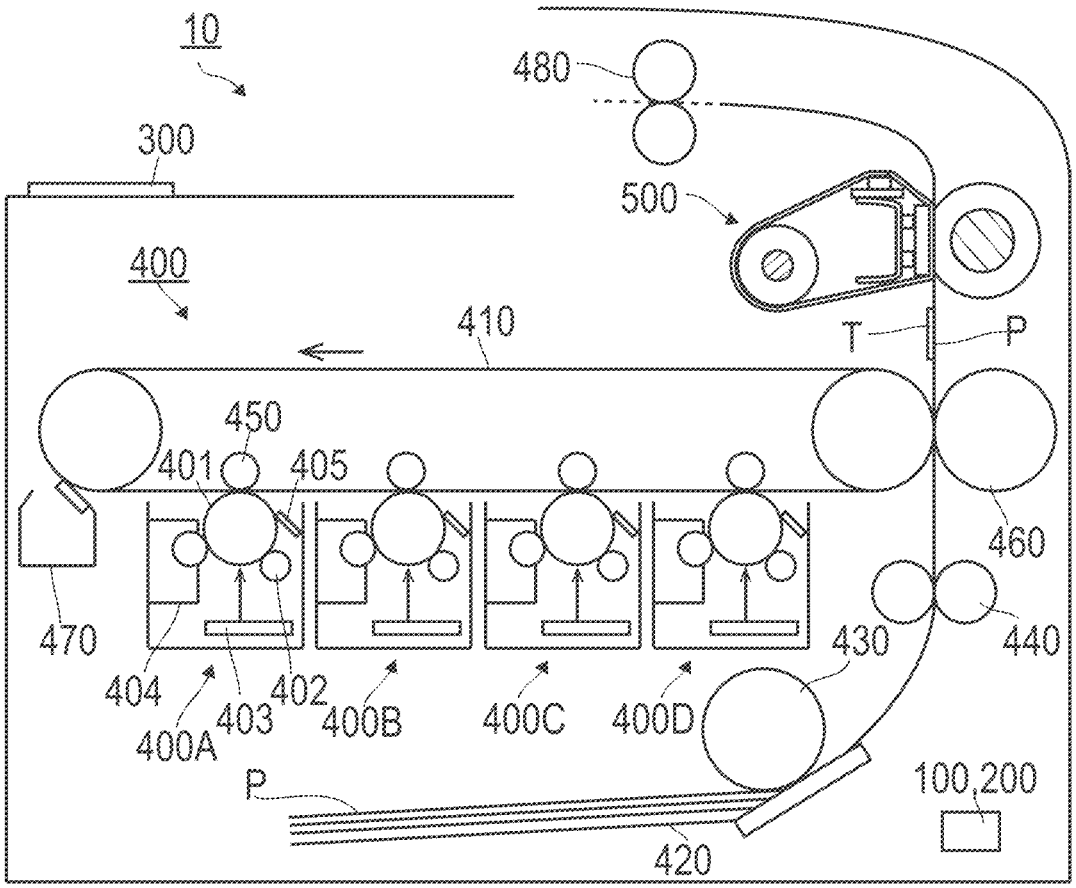
FIG. 1 is a schematic diagram illustrating a configuration of an image forming apparatus.

Hereinafter, one or more embodiments of the present invention will be described with reference to the drawings. However, the scope of the invention is not limited to the disclosed embodiments.

An image forming apparatus and a control program for the image forming apparatus according to an embodiment of the invention will now be described with reference to the accompanying drawings. Note that like reference numerals denote like elements throughout the drawings, and repeated description will be omitted. In addition, dimensions or scales of some elements in the drawings may be exaggerated differently from real ones for convenient description purposes.

Figure 2:
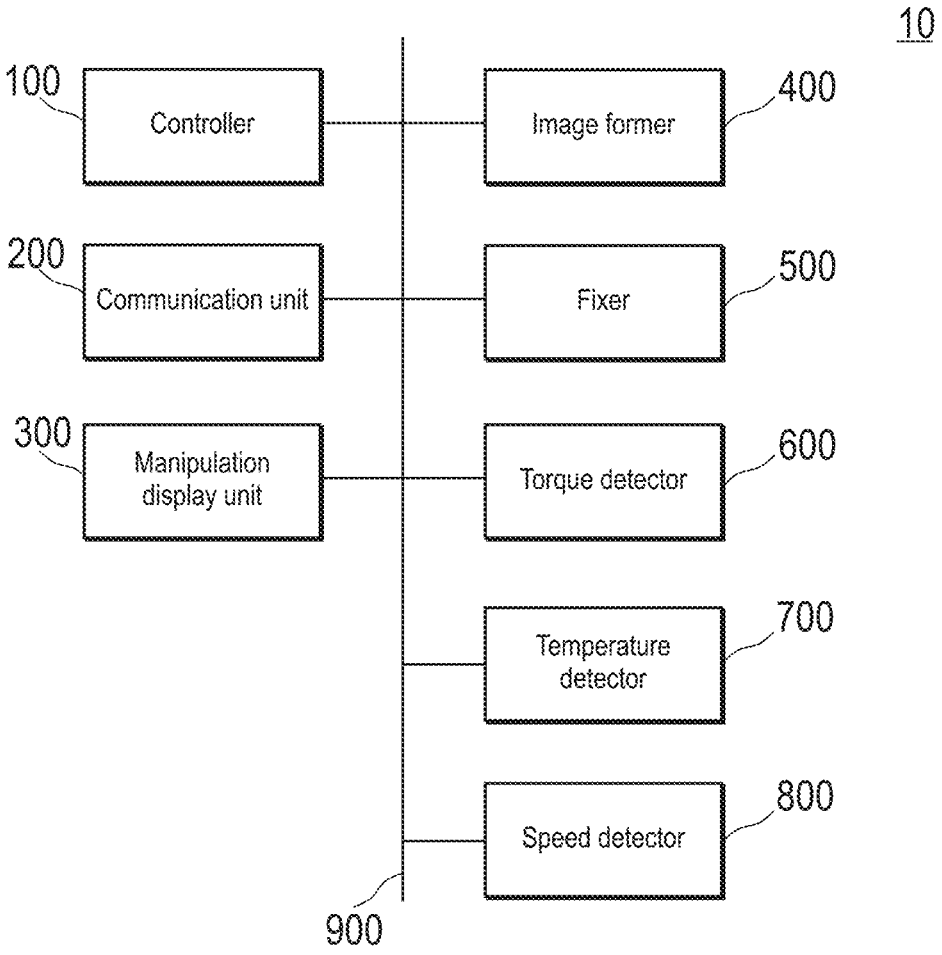
FIG. 2 is a block diagram illustrating a configuration of the image forming apparatus.

FIG. 1 is a schematic diagram illustrating a configuration of the image forming apparatus. FIG. 2 is a block diagram illustrating the configuration of the image forming apparatus.

The image forming apparatus 10 includes a controller 100, a communication unit 200, a manipulation display unit 300, an image former 400, a fixer 500, a torque detector 600, a temperature detector 700, and a speed detector 800. Such elements are communicably connected to each other via a bus 900.

The controller 100 has a CPU (central processing unit) and various types of memories to control each part depending on a program and perform various computation processing.

The communication unit 200 is an interface for performing communication between the image forming apparatus 10 and external devices. The communication unit 200 includes a network interface based on the standard such as Ethernet (registered trademark), SATA, and IEEE1394. In addition, the communication unit 200 may include a wireless communication interface based on the standard such as Bluetooth (registered trademark) or IEEE802.11.

The manipulation display unit 300 has a touch panel, a numerical pad, a start button, a stop button, and the like to display various types of information and receive various types of instruction inputs.

The image former 400 has imaging units 400A to 400D, an intermediate transfer belt 410, a sheet feeding tray 420, a sheet feeding roller 430, a registration roller 440, a primary transfer roller 450, a secondary transfer roller 460, a cleaning unit 470, and a sheet discharge roller 480.

Each of the imaging units 400A to 400D has a photosensitive member 401, a charging unit 402, an exposure unit 403, a developing unit 404, and a cleaning unit 405. The toner images of each color formed by the imaging units 400A to 400D respectively are sequentially transferred onto the intermediate transfer belt 410 and are combined on the intermediate transfer belt 410.

The entire surface of the photosensitive member 401 is electrically charged by the charging unit 402, and the exposure unit 403 performs exposure depending on image data to form a latent image. Here, the latent images having each color are formed respectively by the imaging units 400A to 400D. Each color includes yellow (Y), magenta (M), cyan (C), and black (K).

The developing unit 404 stores toners having colors corresponding to a respective imaging unit 400A to 400D. The latent image formed on the photosensitive member 401 is visualized through development of the developing unit 404 using the toner having a respective color.

Each primary transfer roller 450 is arranged to face the photosensitive member 401 by interposing the intermediate transfer belt 410. The developed toner images having respective colors are transferred onto the intermediate transfer belt 410 by applying a bias voltage for attracting the toner to the primary transfer roller 450 (primary transfer) and are sequentially superimposed to form a full color toner image.

The toner image on the intermediate transfer belt 410 is transferred onto a surface of the recording medium P (for example, sheet) between the intermediate transfer belt 410 and the secondary transfer roller 460 (secondary transfer). In this case, similar to the primary transfer roller 450, a bias voltage for attracting the toner is applied to the secondary transfer roller 460. As a result, an unfixed toner image T is formed on the surface of the recording medium P.

The recording medium P is fed by the sheet feeding roller 430 from the sheet feeding tray 420 to the registration roller 440 one by one and is conveyed to the secondary transfer roller 460 by the registration roller 440.

The toner image T on the recording medium P is transferred to the fixer 500 and is then fixed. The recording medium P on which the toner image T is fixed is conveyed and is discharged to the sheet discharge tray by the sheet discharge roller 480.

Figure 3:
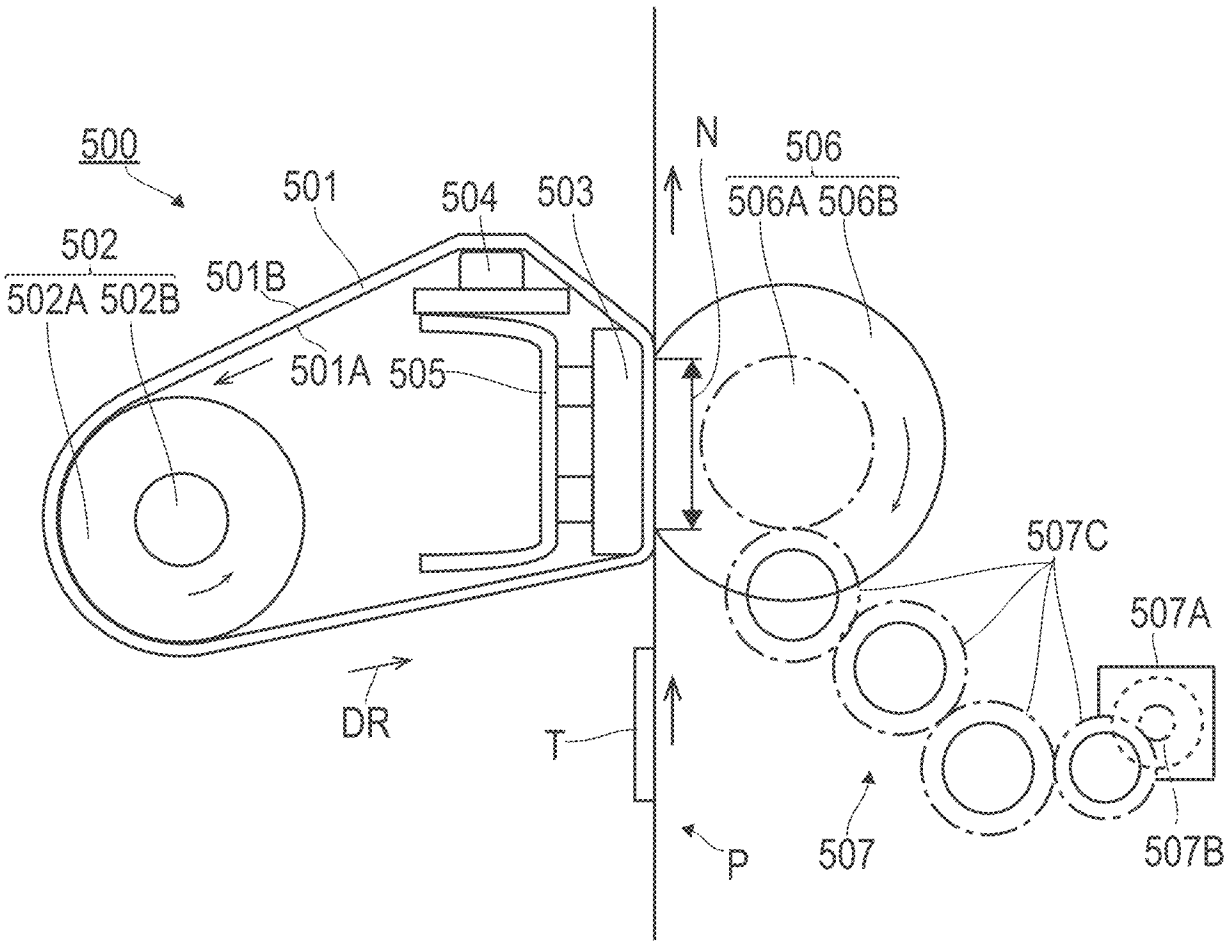
FIG. 3 is a partial enlarged view schematically illustrating a fixer.

FIG. 3 is a partial enlarged view schematically illustrating the fixer.

The fixer 500 includes a fixing belt 501, a heating unit 502, a pad 503, a lubricant applying unit 504, a support member 505, a pressing roller 506, and a driving mechanism 507. Each of the fixing belt 501 and the pressing roller 506 serves as a rotating body. The fixer 500 fixes the toner image T on the surface of the recording medium P by pressing and heating the recording medium P having a surface on which the toner image T is formed while the recording medium P passes through the nip portion N.

The fixing belt 501 is an endless belt and is rotated along a circumferential direction (arrow direction DR). The heating unit 502, the pad 503, the lubricant applying unit 504, and the support member 505 are arranged in the inner circumferential surface 501A side of the fixing belt 501.

The heating unit 502 has a heating roller 502A and a heat source 502B. The heat source 502B includes, for example, a halogen heater or a carbon heater and heats the fixing belt 501 through the heating roller 502A when it is electrically conducted.

The pad 503 is shaped to extend perpendicularly to the paper plane of FIG. 3 and is arranged to make contact with the inner circumferential surface 501A of the fixing belt 501.

The lubricant applying unit 504 is arranged to make contact with the inner circumferential surface 501A of the fixing belt 501 to supply lubricant (grease) to the inner circumferential surface 501A. The lubricant is supplied to a gap between the inner circumferential surface 501A of the fixing belt 501 and the pad 503 as the fixing belt 501 is rotated.

The support member 505 is shaped to extend along an extending direction of the pad 503. Both longitudinal ends of the support member 505 are fixed to a casing (not illustrated) of the fixer 500. As a result, the pad 503 is fixed to the casing of the fixer 500 or the like using the support member 505.

The pressurizing force from the pressing roller 506 is applied to the pad 503 through the fixing belt 501. The support member 505 supports the pad 503 in the opposite side of the pad 503 to face this pressing force. The support member 505 fixes the pad 503 to a predetermined position and prevents the pad 503 from being deviated from the predetermined position.

The pressing roller 506 presses the pad 503 through the fixing belt 501. As a result, the fixing belt 501 and the pressing roller 506 pressedly abut on each other to form the nip portion N having a predetermined nip width between an outer circumferential surface of the pressing roller 506 and an outer circumferential surface 501B of the fixing belt 501.

The recording medium P is pressed and heated by being nipped at the nip portion N, and is conveyed as the pressing roller 506 and the fixing belt 501 rotate. The fixing belt 501 may be rotated to follow the rotation of the pressing roller 506.

The pressing roller 506 has a core metal 506A serving as a driving shaft and an elastic layer 506B provided to surround the outer surface of the core metal 506A. The elastic layer 506B is formed of, for example, foamable silicone rubber, silicone rubber, fluoro rubber, or the like. A release layer formed of, for example, PFA (tetrafluoroethylene-perfluoroalkylvinylether copolymer), PTFE (polytetrafluoroethylene), or the like may be provided on a surface layer of the elastic layer 506B.

The pressing roller 506 is rotationally driven by the torque generated from a motor 507A of the driving mechanism 507. The torque of the motor 507A is transmitted from the motor shaft 507B to the core metal 506A of the pressing roller 506 via a transmission gear 507C. The motor 507A may include a DC brushless motor.

The torque detector 600 detects a torque of the motor 507A of the driving mechanism 507. The torque detector 600 can detect the torque of the motor 507A, for example, from a measurement value of a power current supplied to a power source of the DC brushless motor of the motor 507A. The power current supplied to the power source of the DC brushless motor is detected by connecting a resistor having a known resistance in series to a wiring line that supplies the power current and measuring a voltage drop caused by the power current flowing through the resistor.

The temperature detector 700 detects temperatures of the fixing belt 501 and the pressing roller 506. The temperature detector 700 detects a temperature of the fixing belt 501 (hereinafter, referred to as a "fixing belt temperature") using a temperature sensor provided in the vicinity of the heating unit 502 of the fixing belt 501. A thermistor may be employed as the temperature sensor. The temperature detector 700 can detect a temperature of the pressing roller 506 (hereinafter, referred to as a "pressing roller temperature") by causing a contact type temperature sensor to make contact with the pressing roller 506. The contact type temperature sensor may include a thermistor. The temperature detector 700 can detect a median temperature for a predetermined detection period (hereinafter, simply referred to as a "detection period"). The detection period may be set to a predetermined period of time at an arbitrary timing. The predetermined period of time may be set to an arbitrary value through experiments from the viewpoint of accuracy in life estimation.

The speed detector 800 detects a conveyance speed of the recording medium P conveyed in the fixer 500. The conveyance speed can be detected by calculation based on a measurement value of the rotation speed of the pressing roller 506. The rotation speed of the pressing roller 506 may be measured using a method using an encoder known in the art. The encoder has a wheel (not illustrated) connected to the core metal 36A of the pressing roller 506 and a photosensor (not illustrated) that detects light passing through a slit provided in the wheel.

Figure 4:
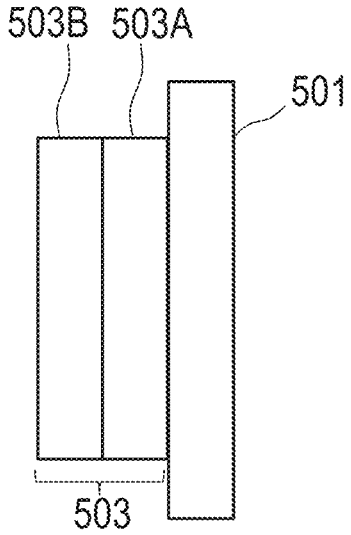
FIG. 4 is an explanatory diagram illustrating a configuration of a pad.

FIG. 4 is an explanatory diagram illustrating a configuration of the pad. In FIG. 4, the fixing belt 501 that presses the pad 503 is also illustrated.

The pad 503 may include a slidable sheet. The slidable sheet has a structure in which a glass fiber material 503B is coated with a fluorine coat 503A. The pad 503 and the fixing belt 501 slide while the pad 503 is pressed by the fixing belt 501. As expiration of the life of the pad 503 approaches, the fluorine coat 503A of the slidable sheet is exfoliated, so that the glass fiber material 503B slides with the fixing belt 501. As a result, friction increases as the fixing belt 501 slides with the pad 503, so that the torque of the motor 507A of the driving mechanism 507 increases. For this reason, in order to avoid influence to the motor 507A or the like, as the torque of the motor 507A increases and reaches a predetermined torque, it is determined that the pad 503 reaches the life of pad 503 (hereinafter, simply referred to as a "life"), and it is necessary to replace the pad 503.

The function of the controller 100 will be described in more details.

Figure 5:
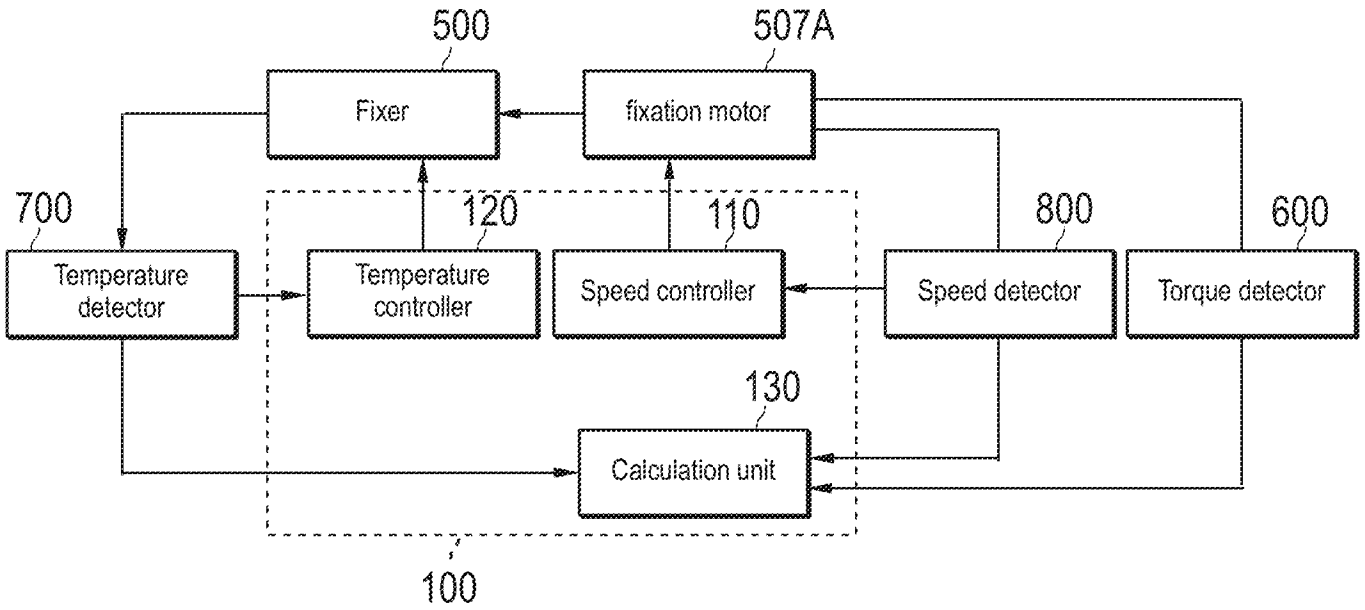
FIG. 5 is a block diagram illustrating an image forming apparatus for describing functions of a controller.

FIG. 5 is a block diagram illustrating the image forming apparatus for describing the function of the controller. The function of the controller 100 includes functions of a temperature controller 120, a speed controller 110, and a computation unit 130.

The temperature controller 120 controls the fixing belt temperature and the pressing roller temperature by driving and electrically conducting the heating unit 502 on the basis of the fixing belt temperature and the pressing roller temperature detected by the temperature detector 700. As a result, a fixation temperature which is the temperature of the nip portion N is controlled. The speed controller 110 controls the conveyance speed by driving the motor 507A on the basis of the conveyance speed of the recording medium P detected by the speed detector 800.

The calculation unit 130 corrects the torque detected by the torque detector 600 on the basis the fixing belt temperature and the pressing roller temperature detected by the temperature detector 700, and the conveyance speed detected by the speed detector 800. Torque correction will be described below.

Figure 6:
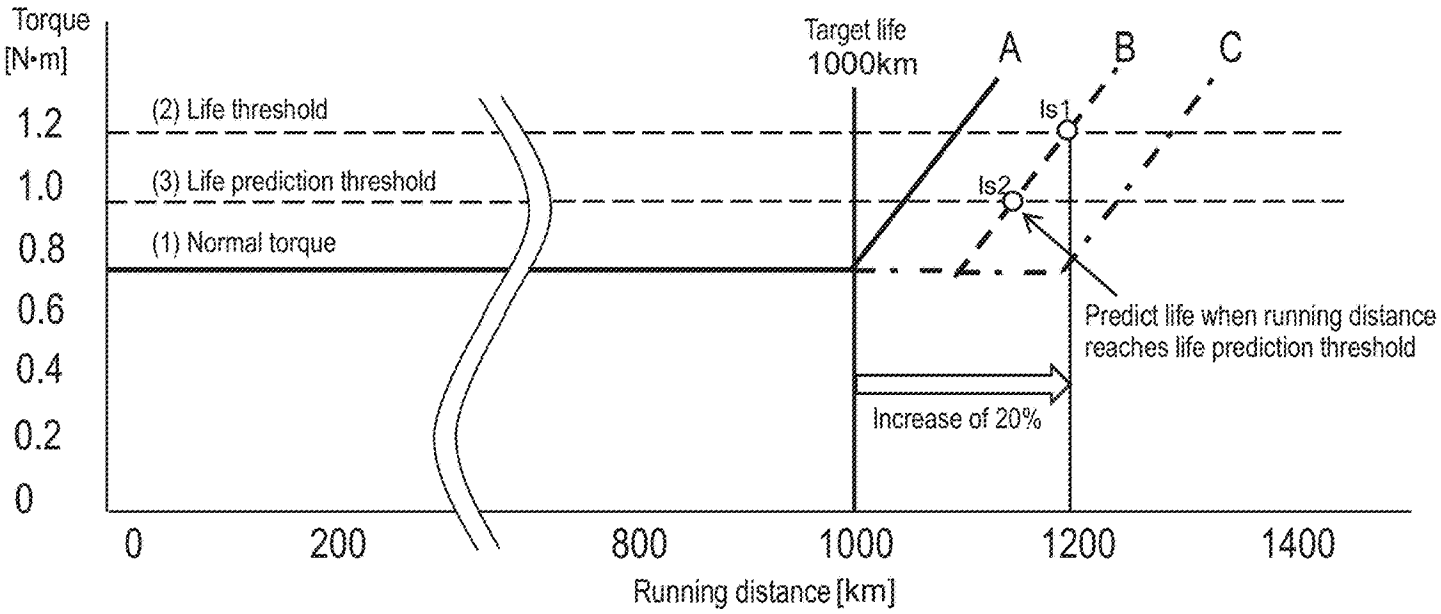
FIG. 6 is a graph for describing life prediction.

FIG. 6 is a graph for describing life prediction. The abscissa of the graph refers to a running distance, and the ordinate refers to a torque of the motor 507A for driving the pressing roller 506. The running distance refers to a distance to which the recording medium P is conveyed starting from an initial use of the image forming apparatus 10. The running distance also refers to a distance to which the recording medium P is conveyed starting from an initial use of the fixer 500 (after replacement). The running distance may be calculated, for example, on the basis of a cumulative count of the recording media P on which images are formed by the image forming apparatus 10. The running distance may also be calculated by a product between a driving time of the driving motor and a feeding distance per hour.

A line "A" is a graph indicating a change of the torque with respect to the running distance when the life is shortest. That is, the line "A" is a graph indicating the change of the torque with respect to the running distance when the image forming apparatus 10 having the shortest life due to a manufacturing variation of the pad 503 or the like is used under the use environment where the life becomes shortest (under the worst condition) within an allowable range of the specification of the image forming apparatus 10. A line "B" is a graph indicating the change of the torque with respect to the running distance when the life is at its average. That is, the line "B" is a graph indicating the change of the torque with respect to the running distance when the image forming apparatus 10 having an average life as a mean value depending on the manufacturing variation of the pad 503 or the like is used under the use environment where the life becomes its average value (under the standard condition) within the allowable range of the specification of the image forming apparatus 10. A line "C" is a graph indicating the change of the torque with respect to the running distance when the life becomes longest. That is, the line "C" is a graph indicating the change of the torque with respect to the running distance when the image forming apparatus 10 having the longest life depending on the manufacturing variation of the pad 503 or the like is used under the use environment where the life becomes longest (under the best condition) within the allowable range of the specification of the image forming apparatus 10.

Referring to the line "A", the torque is at a normal torque until 1,000 km which is a target life (in FIG. 6, the torque (1)). The target life refers to a life generally guaranteed in the specification of the image forming apparatus 10. If the running distance exceeds 1,000 km, the torque may increase. The torque increases because friction increases when the fixing belt 501 and the pad 503 slide due to abrasion of the pad 503 caused by exfoliation of the fluorine coat 503A on the slidable sheet of the pad 503 as described above.

A life threshold (the torque (2) in FIG. 6) refers to a torque when the image forming apparatus 10 reaches the life. A life prediction threshold (the torque (3) in FIG. 6) is set between the normal torque and the life threshold. The life prediction threshold may be set to, for example, a median value between the normal torque and the life threshold.

Comparing the running distance at which the torque starts to increase (that is, 100 km corresponding to the target life) in the line A and the running distance at which the torque starts to increase in the line B, the running distance of the line B is longer, for example, by 10%. In addition, comparing the life of the line A (corresponding to the running distance at which the line A crosses the life threshold (2)) and the life of the line B (corresponding to the runnning distance at the point ls1 where the line B crosses the life threshold (2)), the life of the line B is longer, for example, by 10%. For this reason, as indicated by the arrow of FIG. 6, the running distance until reaching the life of the line B is longer than that of the target life by 20%. In addition, as indicated in the line "C", if the image forming apparatus 10 having the longest life depending on the manufacturing variation of the pad 503 or the like is used under the use environment of the best condition, the running distance until the life is further lengthened.

For example, referring to the line B, the torque increases as the running distance increases. When the torque reaches the life prediction threshold (the line B reaches the point ls2 where the line B crosses the s life prediction threshold (3)), the running distance at which the torque reaches the life threshold is predicted as a life prediction value. Therefore, it is possible to know a replacement time before expiration of the life of the pad 503. As a result, even when the torque starts to increase due to abrasion of the pad 503, it is possible to continuously use the image forming apparatus 10 until the expiration of the life. Therefore, it is possible to reduce replacement frequency of the pad 503 or the like.

Factors influencing on the change of the torque will be described.

Figure 7:
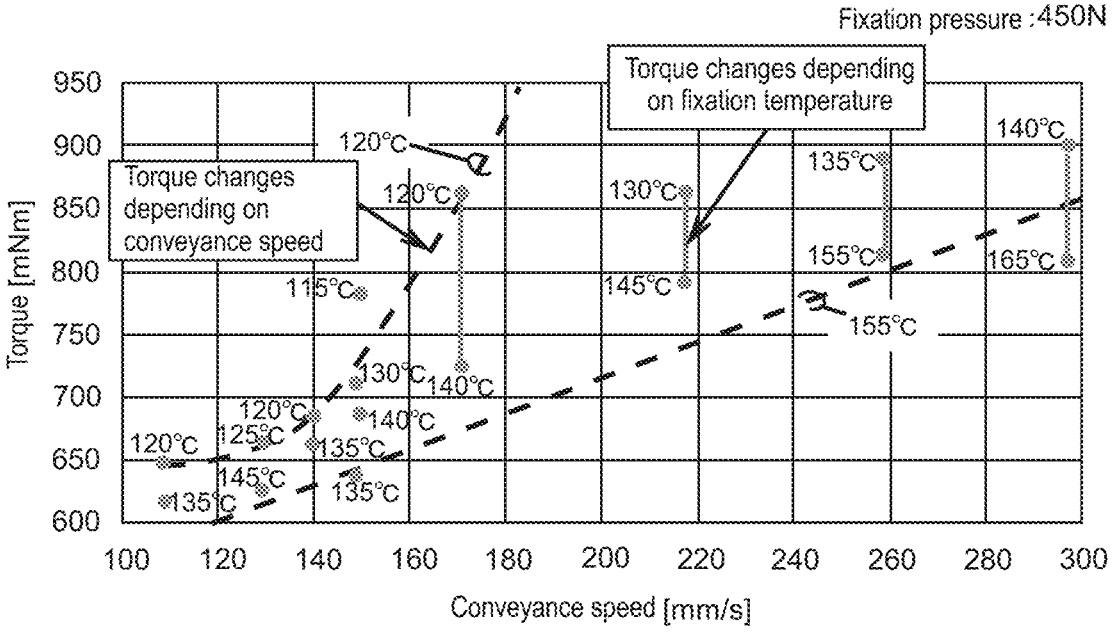
FIG. 7 is a view illustrating a graph of a relationship between a conveyance speed and a torque for each fixing belt temperature.

FIG. 7 is a view illustrating a graph of a relationship between the conveyance speed and the torque for each fixing belt temperature. In FIG. 7, the cases where the fixing belt temperature is at 120° C. and 155° C. are indicated by dashed lines. In addition, an example of the torque change caused by a change of the fixing belt temperature is indicated by a gray solid line. The fixing pressure is set to 450 N.

As illustrated in the graph, the torque increases as the conveyance speed increases. In addition, the torque increases as the fixing belt temperature decreases.

Figure 8:
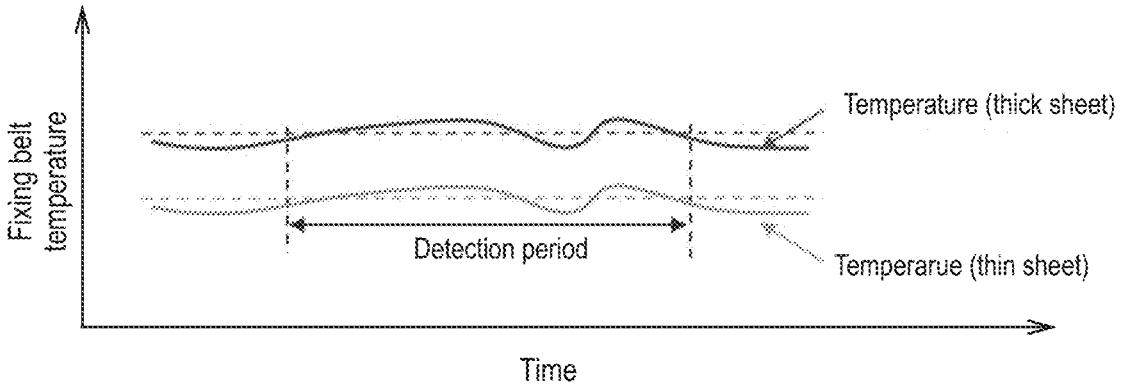
FIG. 8 is an explanatory diagram illustrating a relationship between recording medium thickness and the fixing belt temperature.

FIG. 8 is an explanatory diagram illustrating a relationship between the thickness of the recording medium and the fixing belt temperature.

When the recording medium P is a thick sheet, the fixing belt temperature or the like increases compared to the case of a thin sheet. This is because, in the case of thick sheet, the conveyance speed decreases as the resistance by the sheet thickness increases, and the temperature increases as the conveyance speed decreases as described below. For this reason, the median value of the fixing belt temperature in the detection period for detecting the torque varies depending on the thickness of the recording medium P. The median value of the fixing belt temperature or the like also changes depending on conditions such as the environmental temperature, the time from the warm-up operation, and continuous printing.

Figure 9:
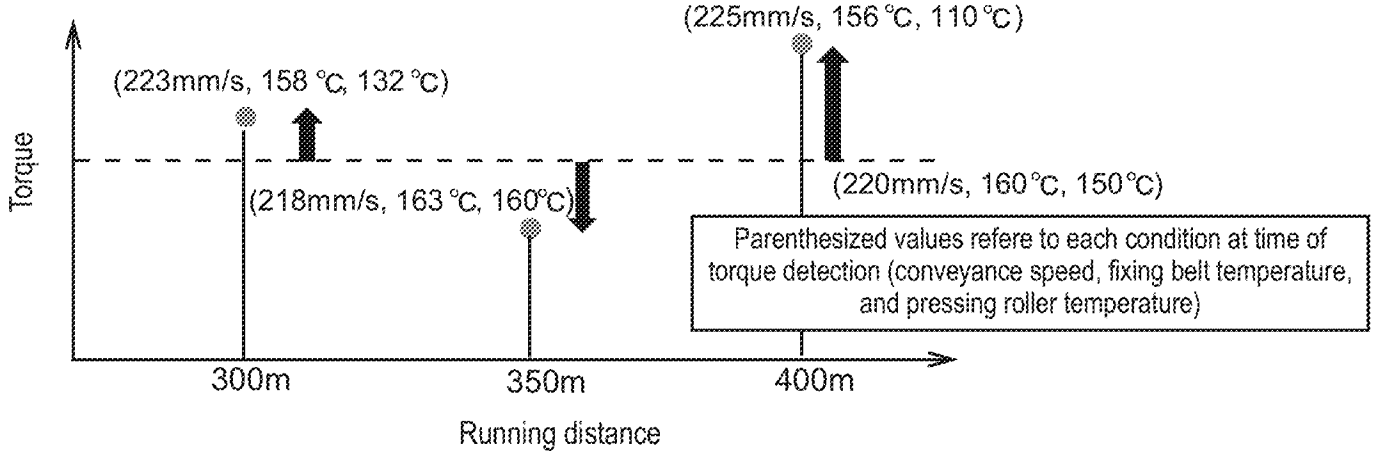
FIG. 9 is an explanatory diagram for describing a change of the torque depending on changes of the fixing belt temperature, the pressing roller temperature, and the conveyance speed.

FIG. 9 is an explanatory diagram for describing a torque change caused by changes in the fixing belt temperature, the pressing roller temperature, and the conveyance speed. In FIG. 9, the running distance refers to a running distance from the start of the detection period. The numerals in parentheses attached to each plot indicate conditions at the time of torque detection. Starting from the left, the numerals refer to the conveyance speed, the fixing belt temperature, and the pressing roller temperature.

Referring to FIG. 9, it is recognized that the fixing belt temperature, the pressing roller temperature, and the conveyance speed change regardless of an increase of the running distance, and the torque can change as a result.

Figures 10, 11:
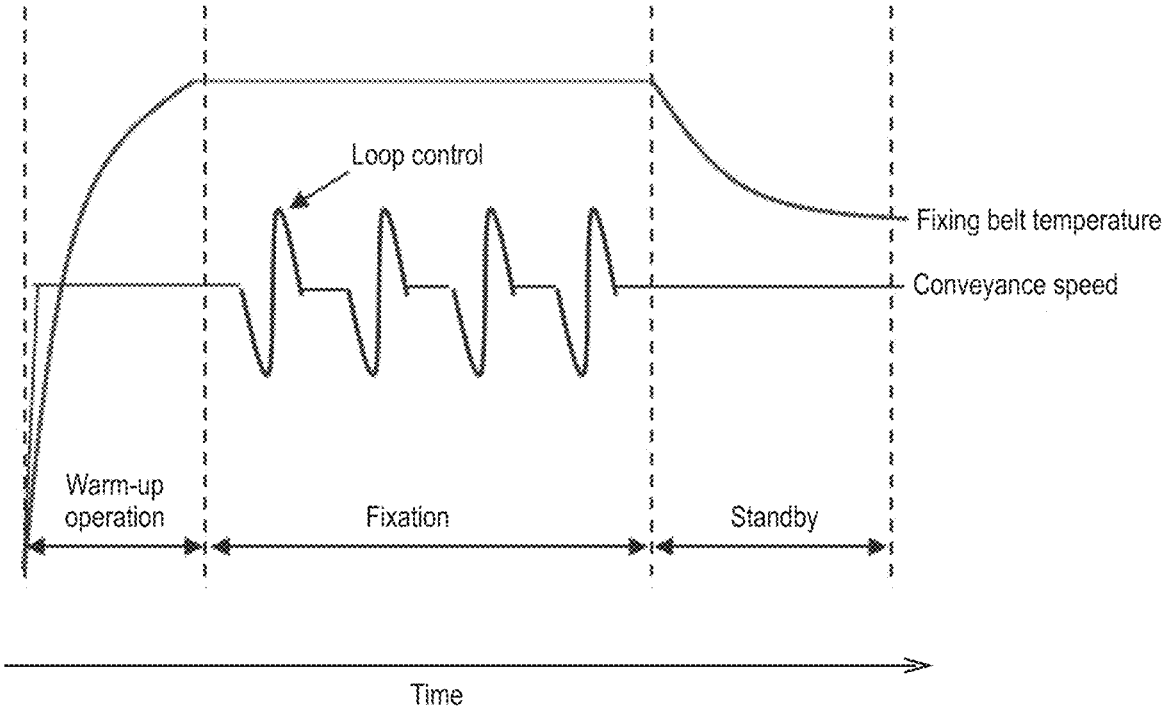
FIG. 10 is an explanatory diagram illustrating the fixing belt temperature and the conveyance speed in a warm-up operation, a fixation operation, and a standby operation in the fixer.
FIG. 11 is a diagram illustrating a relationship between changes of the temperature and the conveyance speed and a change of the torque.

FIG. 10 is an explanatory diagram illustrating the temperature and the conveyance speed of the fixing belt in the warm-up operation, the fixation operation, and the standby operation in the fixer.

When a print job is received by the image forming apparatus 10, the fixer 500 starts the warm-up operation for setting the fixation temperature (the temperature of the nip portion N) to the temperature set in the print job. As a result, a control for accelerating the rotation speeds of the pressing roller 506 and the fixing belt 501 until a certain conveyance speed is obtained is performed, and the fixing belt temperature and the pressing roller temperature increase. During the fixation operation, the fixing belt temperature and the pressing roller temperature are controlled to certain steady values, and the conveyance speed changes by a loop control using the motor 507A for controlling a loop amount of the recording medium P. In the standby operation between print jobs, the conveyance speed is maintained constantly, and the fixation temperature is lowered to a certain temperature. Note that, in the standby operation, the conveyance speed may decrease. The standby operation may also be carried out in each operation such as stabilization of the image forming apparatus 10, cleaning of the intermediate transfer belt 410 or the fixing belt 501, scanning, or the like.

FIG. 11 is a diagram illustrating a relationship between the changes of the temperature and the conveyance speed and a change of the torque.

The torque decreases as the conveyance speed decreases, and the torque increases as the conveyance speed increases. The conveyance speed changes depending on the accuracy of control for the conveyance speed by the motor 507A or the like. The torque decreases as the fixing belt temperature increases, and the torque increases as the fixing belt temperature decreases. The fixing belt temperature changes depending on the temperature adjustment accuracy or the like caused by the temperature controller 120. The torque decreases as the pressing roller temperature increases, and the torque increases as the pressing roller temperature decreases. The pressing roller temperature changes depending on a fact that the inside of the fixer 500 has not reached a steady state, that is, the warming state of the fixer 500, or the like. The torque is relatively significantly affected by viscosity of the lubricant supplied between the inner circumferential surface 501A of the fixing belt 501 and the pad 503.

Figure 12:
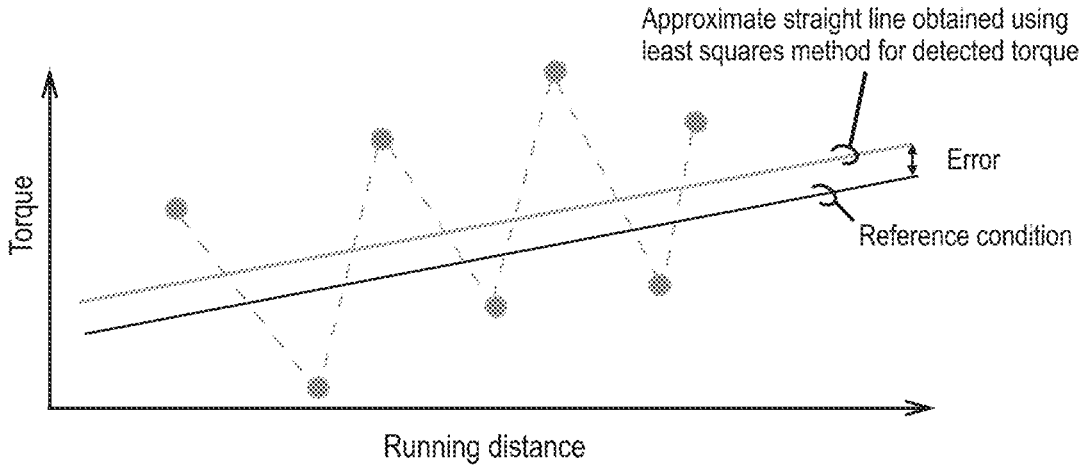

FIG. 12 is a diagram illustrating a relationship between the running distance and the detected torque after the torque starts to increase due to abrasion of the pad of the fixer or the like.

Since the torque increases due to abrasion of the pad 503 or the like, a relational expression between the running distance and the detected torque is obtained, and the life can be estimated on the basis of the relational expression. For example, the relational expression between the running distance and the torque is calculated as an approximate expression by the least squares method. The relationship between the running distance and the detected torque is plotted by gray dots. The approximate expression (approximate straight line) indicating the relationship between the running distance and the torque calculated by the least squares method is shown by a gray straight line. As described above, the torque changes depending on the fixing belt temperature, the pressing roller temperature, and the conveyance speed. For this reason, the approximate expression is calculated from the torque detected at the fixing belt temperature, the pressing roller temperature, the conveyance speed different from those of a reference condition set as a condition for estimating the life (hereinafter, simply referred to as a "reference condition"), and the life is estimated on the basis of this approximate expression. In this calculation, an error may occur in the estimation result. The relational expression between the conveyance speed and torque under the standard condition is shown by a black straight line. The standard condition may be set to an arbitrary value through experiments from the viewpoint of the accuracy in life estimation. The reference condition may be set to, for example, the conveyance speed of 220 mm/s, the fixing belt temperature of 160° C., and the pressing roller temperature of 150° C. Hereinafter, the conveyance speed under the reference condition will be referred to as a reference speed (predetermined reference speed). The fixing belt temperature and the pressing roller temperature under the reference condition will be referred to as reference temperatures (predetermined reference temperatures).

In this embodiment, the detected torque is corrected on the basis of the detected fixing belt temperature, the detected pressing roller temperature, and the detected conveyance speed. In addition, the life is predicted on the basis of the corrected torque.

FIG. 13 is a table that defines correction coefficients for correcting the detected torque to the torque under the reference condition for each conveyance speed and each fixing belt temperature, and for each fixing belt temperature and each pressing roller temperature. The left figure of FIG. 13 is a table that defines correction coefficients K1 corresponding to combinations of the conveyance speed and the fixing belt temperature. The right figure of FIG. 13 is a table that defines correction coefficients K2 corresponding to combinations of the fixing belt temperature and the pressing roller temperature.

The corrected torque $\tau 2$ can be calculated by multiplying the detected torque $\tau 1$ which is an uncorrected torque by the correction coefficient K1 and the correction coefficient K2. Specifically, it can be calculated by the following Formula (1).

$$\tau 2 = K1 \times K2 \times \tau 1 \quad (1)$$

Figure 14:
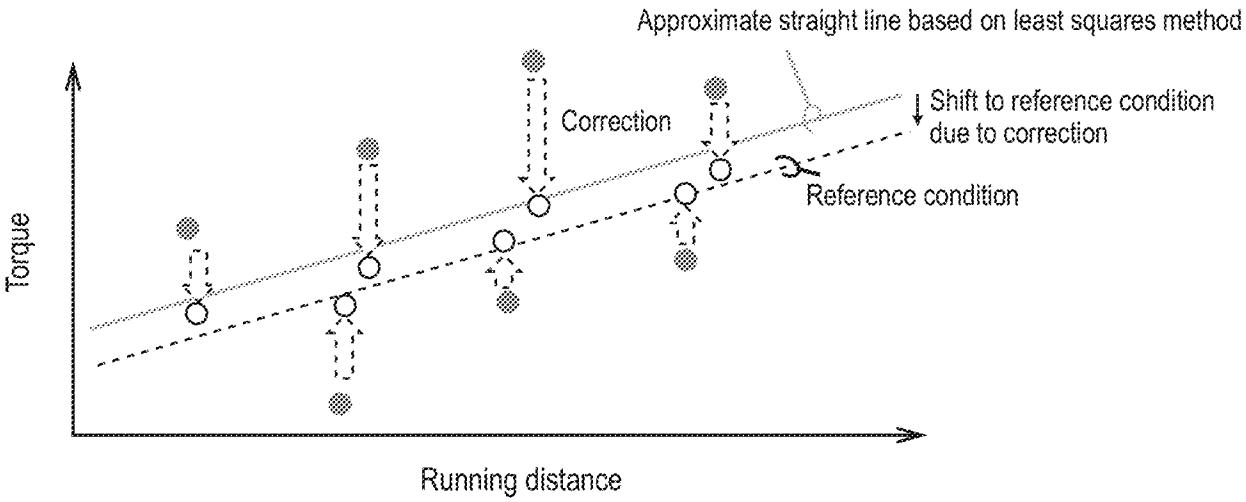

FIG. 14 is a diagram illustrating a relationship between the running distance and the detected torque before and after the correction after the torque starts to increase due to abrasion of the pad of the fixer or the like. The relationship between the running distance and the detected torque indicated by gray dots in FIG. 14 corresponds to a relationship between the running distance and the detected torque of FIG. 12. The approximate expression of the relationship between the running distance and the torque by the least squares method shown by the gray straight line in FIG. 14 corresponds to the approximate expression of the relationship between the running distance and the torque of FIG. 12. The relationship between the running distance and the detected torque under the reference condition is shown by a black dashed line.

The corrected torque indicated by a white circle in FIG. 14 approaches the relationship between the running distance and the detected torque under the reference condition as indicated by the dashed arrows.

The operation of the image forming apparatus 10 will be described.

Figure 15:
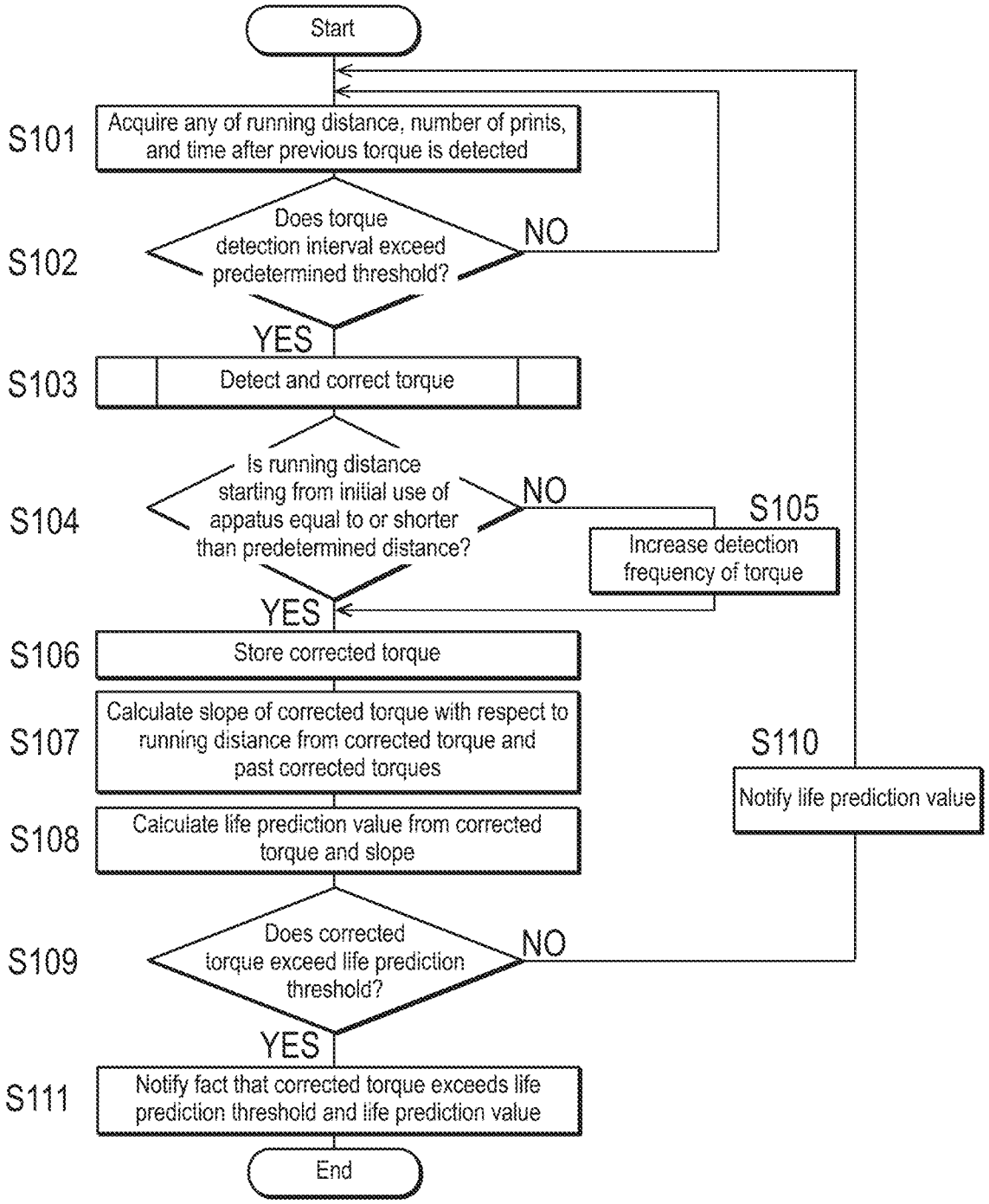
FIG. 15 is a flowchart illustrating operations of the image forming apparatus.

FIG. 15 is a flowchart illustrating operations of the image forming apparatus. This flowchart may be executed by the controller 100 on the basis of a program.

The controller 100 obtains the running distance after detecting the previous torque by reading the running distance from the memory (S101). Note that this step and the next step S102 are not executed when the torque is first detected by the torque detector 600. The controller 100 may acquire the number of printed sheets or the time after detecting the previous torque instead of the running distance.

The controller 100 determines whether or not the running distance after detecting the previous torque as a torque detection interval for periodically detecting the torque exceeds a predetermined threshold (S102). The predetermined threshold may be set to an arbitrary value through experiments from the viewpoint of the accuracy in life estimation.

If it is determined that the torque detection interval does not exceed the predetermined threshold (S102: NO), the controller 100 repeats steps S101 and S102 until it is determined that the torque detection interval exceeds the predetermined threshold.

If it is determined that the torque detection interval exceeds the predetermined threshold (S102: YES), the controller 100 detects the torque using the torque detector 600 and corrects the detected torque (S103). The torque may be detected at a timing of any operation state (such as sleep operation, warm-up operation, fixation operation, or standby operation) of the fixing device. This is because the detected torque under an arbitrary condition is corrected to the detected torque under the reference condition in step S209.

Figure 16:
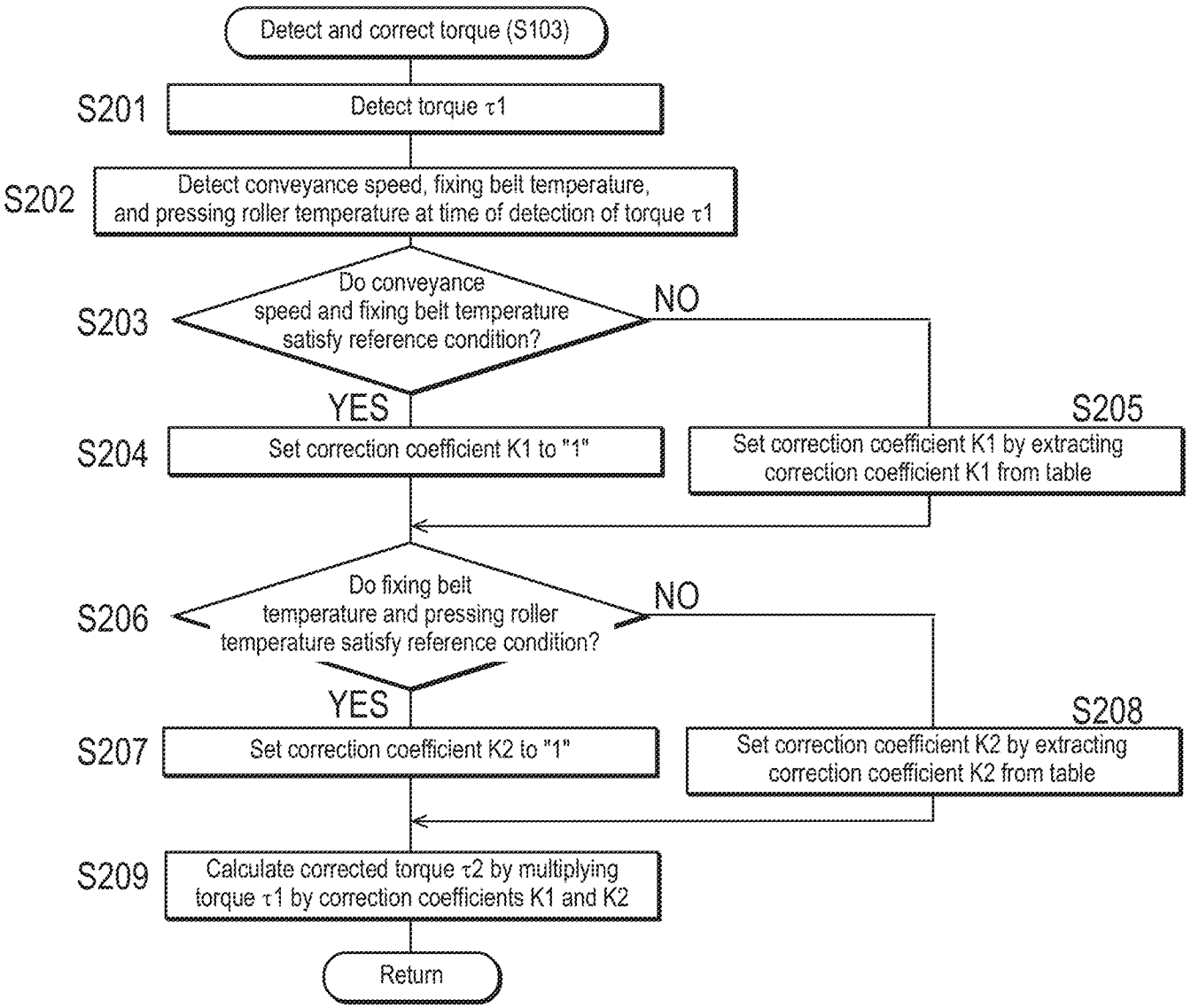
FIG. 16 is a flowchart illustrating a subroutine of step S103 of FIG. 15.

FIG. 16 is a flowchart illustrating a subroutine of step S103 of FIG. 15.

The controller 100 detects the torque $\tau 1$ as an uncorrected torque (S201).

The controller 100 detects the conveyance speed, the fixing belt temperature, and the pressing roller temperature at the time of detecting the uncorrected torque $\tau 1$ (S202).

The controller 100 determines whether or not the conveyance speed and the fixing belt temperature satisfy the respective reference condition (S203). If it is determined that the conveyance speed and the fixing belt temperature satisfy the respective reference condition (S203: YES), the controller 100 sets the correction coefficient K1 corresponding to a combination of the conveyance speed and the fixing belt temperature to "1". That is, correction of the torque depending on changes of the conveyance speed and the fixing belt temperature is not performed.

If it is determined that the conveyance speed and the fixing belt temperature do not satisfy the respective reference condition (S203: NO), the controller 100 extracts the correction coefficient K1 corresponding to a combination of the conveyance speed and the fixing belt temperature from the table and sets the correction coefficient K1 (S205).

The controller 100 determines whether or not the fixing belt temperature and the pressing roller temperature satisfy the respective reference condition (S206). If it is determined that the fixing belt temperature and the pressing roller temperature satisfy the respective reference condition (S206: YES), the controller 100 sets the correction coefficient K2 corresponding to a combination of the fixing belt temperature and the pressing roller temperature to "1". That is, correction of the torque depending on changes of the fixing belt temperature and the pressing roller temperature is not performed.

If it is determined that the fixing belt temperature and the pressing roller temperature do not satisfy the respective reference condition (S206: NO), the controller 100 extracts the correction coefficient K2 corresponding to the combination of the fixing belt temperature and the pressing roller temperature from the table and sets the correction coefficient K2 (S205).

The controller 100 calculates the corrected torque $\tau 2$ by multiplying the uncorrected torque $\tau 1$ by the correction coefficient K1 and the correction coefficient K2 using the aforementioned Formula (1) (S209).

The controller 100 determines whether or not the running distance starting from an initial use of the image forming apparatus 10 is equal to or shorter than a predetermined distance (S104). The predetermined distance may be set as, for example, the target life. If it is determined that the running distance is equal to or shorter than the predetermined distance (S104: YES), the controller 100 advances to step S106.

If it is determined that the running distance is not equal to or shorter than the predetermined distance (S104: NO), the controller 100 increases torque detection frequency in steps S101 to S103 and the like.

The controller 100 stores the corrected torque (S106).

The controller 100 calculates a slope of the corrected torque with respect to the running distance from the corrected torque and the past corrected torque (S107), and calculates the life prediction value on the basis of the corrected torque and this slope (S108). The life prediction value refers to the remaining running distance from the current time to the running distance estimated at the end of the life. Specifically, the life prediction value may be calculated as described below. That is, a relationship between the running distance and the corrected torque is calculated as an approximate expression of a linear function having the aforementioned slope. Then, the running distance at the current time (when the torque is detected in step S103) is subtracted from the running distance when the torque reaches the life threshold in the aforementioned approximate expression. Note that the approximate expression may be a quadratic function or the like. In addition, the approximate expression may be calculated using the least squares method.

The controller 100 determines whether or not the corrected torque exceeds the life prediction threshold (S109). If it is determined that the corrected torque does not exceed the life prediction threshold (S109: NO), the controller 100 notifies the life prediction value. The life prediction value may be notified to a user, for example, by displaying it on the manipulation display unit 300. The life prediction value may be notified to an administrator by transmitting a notification from the communication unit 200 to a mobile terminal of the administrator of the image forming apparatus 10 along with information that enables designation of the image forming apparatus 10.

If it is determined that the corrected torque exceeds the life prediction threshold (S109: YES), the controller 100 notifies the life prediction value along with a message indicating that the torque exceeds the life prediction threshold (S111).

Figure 17:
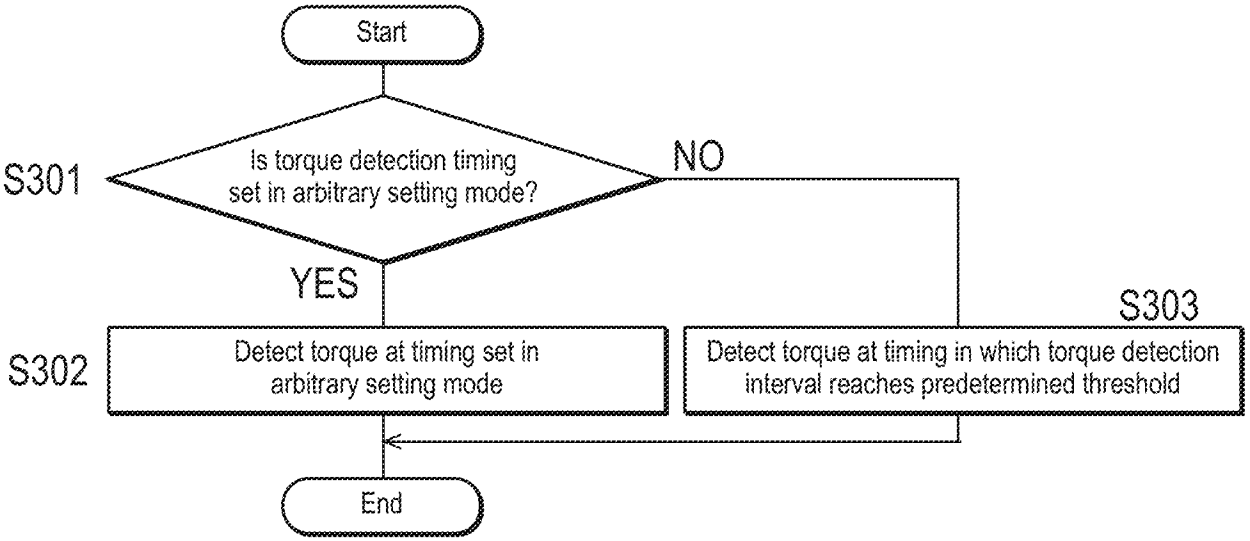
FIG. 17 is a flowchart for determining a torque detection timing.

FIG. 17 is a flowchart for determining the torque detection timing. Note that the process of FIG. 17 may be executed instead of step S102 of the flowchart of FIG. 15.

The controller 100 determines whether or not the torque detection timing is set in an arbitrary setting mode (S301). The arbitrary setting mode refers to a mode in which the administrator of the image forming apparatus 10 is allowed to set the torque detection timing to a timing different from that of a preset default setting. Shifting to the arbitrary setting mode and the setting of the torque detection timing in the arbitrary setting mode may be performed by the administrator on the manipulation display unit 300.

If it is determined the torque detection timing is not set in the arbitrary setting mode (S301: NO), the controller 100 detects the torque when the running distance after detection of the previous torque as a torque detection interval exceeds the predetermined threshold (S303).

If it is determined that the torque detection timing is set to the arbitrary setting mode (S301: YES), the controller 100 detects the torque at the timing set in the arbitrary setting mode (S302).

The timing set in the arbitrary setting mode may be a timing after a predetermined time after the warm-up operation of the fixer 500 is terminated. The predetermined time may be set to an arbitrary value through experiments from the viewpoint of the accuracy in the life estimation.

The timing set in the arbitrary setting mode may be a timing at which the temperature detected by the temperature detector 700 is within a temperature range in the specification of the life prediction condition of the image forming apparatus 10.

The timing set in the arbitrary setting mode may be "before printing", "after printing", or "during waiting".

Figure 18:
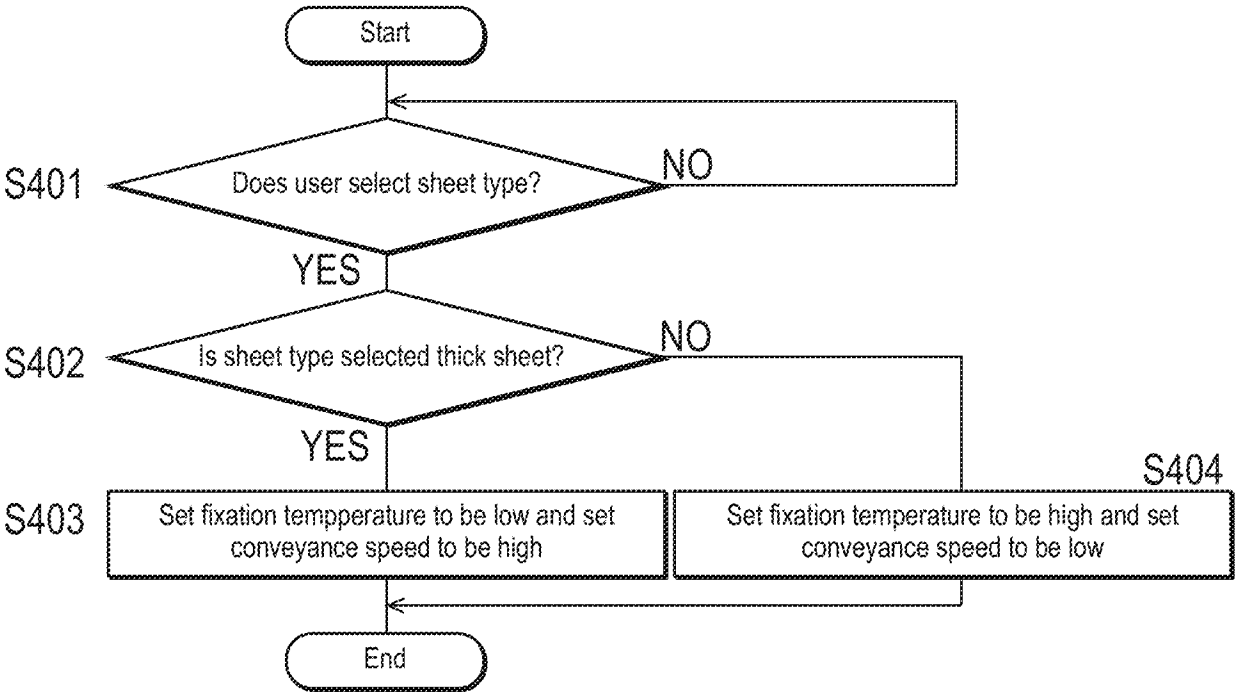
FIG. 18 is a flowchart illustrating a control for changing the fixation temperature and the conveyance speed depending on a sheet type of the recording medium.

FIG. 18 is a flowchart illustrating a control for changing the fixation temperature and the conveyance speed depending on a sheet type of the recording medium.

The controller 100 determines whether or not the sheet type of the recording medium P where the image is formed is selected by the user (S401). The controller 100 may determine that the sheet type of the recording medium P is selected by a user, for example, as the sheet type of the recording medium P is selected on a selection screen displayed on the manipulation display unit 300.

If it is determined that the sheet type is selected by the user (S401: YES), the controller 100 determines whether or not the selected sheet type is the thick sheet (S402).

If it is determined that the selected sheet type is the thick sheet (S402: YES), the controller 100 sets the fixation temperature to be low and sets the conveyance speed to be high. When the sheet type is the thick sheet, a resistance by the sheet thickness increases, so that the conveyance speed of the recording medium P conveyed by the fixer 500 is lowered. As the conveyance speed decreases, the fixing belt temperature or the like increases. As a result, the conveyance speed, the fixing belt temperature, or the like become higher than the reference speed and the reference temperature, respectively. Therefore, when the sheet type of the recording medium P is the thick sheet, the fixation temperature is set to be low, and the conveyance speed is set to be high, so that it is possible to reduce a difference between the reference condition and the conveyance speed, the fixing belt temperature, or the like. As a result, it is possible to improve the torque correction accuracy due to an increase of the difference between the reference condition and the conveyance speed, the fixing belt temperature, or the like.

If it is determined that the selected sheet type is the thin sheet (S402: NO), the controller 100 sets the fixation temperature to be high and sets the conveyance speed to be low. If the sheet type is the thin sheet, the resistance caused by the sheet thickness reduces, so that the conveyance speed of the recording medium P conveyed by the fixer 500 increases. As the conveyance speed increases, the fixing belt temperature or the like decreases. As a result, the conveyance speed, the fixing belt temperature, or the like become higher than the reference speed and the reference temperature, respectively. Therefore, if the sheet type of the recording medium P is the thin sheet, the fixation temperature is set to be high, and the conveyance speed is set to be low, so that it is possible to reduce a difference between the reference condition and the conveyance speed, the fixing belt temperature, or the like. As a result, it is possible to improve torque correction accuracy due to an increase of the difference between the reference condition and the conveyance speed, the fixing belt temperature, or the like.

Alternatively, the reference condition may change depending on the sheet type of the recording medium P. For example, if the sheet type is the thick sheet, the conveyance speed decreases, and the fixing belt temperature or the like increase as described above. For this reason, if the sheet type is the thick sheet, the reference speed may be set to be low, and the reference temperature may be set to be high. If the sheet type is the thin sheet, the reference speed may be set to high, and the reference temperature may be set to be low. As a result, it is possible to reduce a difference between the reference condition and the conveyance speed, the fixing belt temperature, or the like.

It is possible to obtain the following effects according to the embodiment of the present invention.

The detected torque of the motor used to drive the rotating body is corrected the basis of at least any one of the temperature of the rotating body that forms the nip portion and the conveyance speed, and the life of the fixer is predicted on the basis of the corrected torque. As a result, it is possible to easily and efficiently improve the life prediction accuracy of the fixer.

The torque is corrected by multiplying the detected torque by the coefficient corresponding to the conveyance speed detected at the time of the torque detection. As a result, it is possible to more easily improve the accuracy in the life prediction of the fixer.

If the detected conveyance speed is faster than the reference speed, the coefficient is set to be smaller than "1". If the detected conveyance speed is slower than the reference speed, the coefficient is set to be larger than "1". As a result, it is possible to suppress a calculation load in the torque correction.

One of the two rotating bodies is a fixing belt, and the other rotating body is the pressing roller. The torque is corrected on the basis of the temperature of at least any one of the fixing belt and the pressing roller detected at the time of the torque detection. As a result, it is possible to further improve the accuracy in the life prediction.

The torque is corrected on the basis of at least any one of the temperature and the conveyance speed detected after a predetermined time passes from the end of the warm-up operation of the fixer. As a result, it is possible to suppress degradation of accuracy in the life prediction caused by the detection error of the torque by detecting the torque at the stable temperature after the temperature reaches the steady state.

The torque is corrected by multiplying the torque by the coefficient corresponding to the temperature detected at the time of torque detection. As a result, it is possible to more easily improve the life prediction accuracy of the fixer.

If the detected temperature is lower than the reference temperature, the coefficient is set to be smaller than "1". If the detected temperature is higher than the reference temperature, the coefficient is set to be larger than "1". As a result, it is possible to suppress a calculation load for correcting the torque.

One of the two rotating bodies is the fixing belt, and the other rotating body is the pressing roller. The detected torque is multiplied by the coefficient corresponding to the combination of the conveyance speed and the fixing belt temperature, which is detected at the time of torque detection. At the same time, the torque is further multiplied by the coefficient corresponding to the combination of the fixing belt temperature and the pressing roller temperature, which is detected at the time of torque detection, so as to correct the torque. As a result, it is possible to further improve the life prediction accuracy.

The detected torque is corrected when the detected temperature is within the temperature range in the specification of the life prediction condition of the image forming apparatus. As a result, it is possible to limitatively perform correction within the range in the specification of the life prediction condition of the image forming apparatus. Therefore, it is possible to further improve the life prediction accuracy.

A storage unit for storing the table in which at least any one of the conveyance speed and the temperature is associated with the coefficient is provided. In addition, the torque is corrected by multiplying the detected torque by at least any of the coefficient corresponding to the conveyance speed detected at the time of torque detection, the coefficient corresponding to detected temperature at the time of torque detection, and the coefficient corresponding to the combination of the conveyance speed and the temperature, which is detected at the time of torque detection, on the basis of the table. As a result, it is possible to allow the user to avoid cumbersomeness in setting of the coefficient.

The running distance of the recording medium by conveyance of the fixer starting from the initial use of the image forming apparatus is calculated, and the detected torque is corrected for each predetermined running distance. In addition, the approximate expression of the torque with respect to the running distance is calculated on the basis of the relationship between the running distance and the corrected torque. Furthermore, the life of the fixer is predicted on the basis of the increase amount of the torque with respect to the running distance, calculated from the approximate expression. As a result, it is possible to perform life prediction with higher accuracy as expiration of the life approaches.

The image forming apparatus and the control program for the image forming apparatus according to the present invention are not limited to the aforementioned embodiments.

For example, the detected torque may be corrected on the basis of only the detected temperature. Alternatively, the detected torque may be corrected on the basis of only the detected conveyance speed.

The table may be a table that defines the coefficient corresponding only to the conveyance speed. Alternatively, the table may be a table that defines coefficients corresponding only to the fixing belt temperature. Alternatively, the table may be a table that defines coefficients corresponding only to the pressing roller temperature.

The torque may be corrected by multiplying at least any one of the coefficient corresponding only to the conveyance speed, the coefficient corresponding only to the fixing belt temperature, the coefficient corresponding only to the pressing roller temperature.

The nip portion may be formed by causing the pressing roller as the rotating body to pressedly abut on the fixing roller. In this case, the life of the pressing roller or the fixing roller can be predicted on the basis of the corrected torque.

A part or all of the processings executed by the program according to the embodiment may be substituted with hardware such as a circuit.

Although embodiments of the present invention have been described and illustrated in detail, the disclosed embodiments are made for purpose of illustration and example only and not limitation. The scope of the present invention should be interpreted by terms of the appended claims.

What is claimed is:

1. An image forming apparatus comprising:

a fixer that fixes a toner image formed on a recording medium by pressing and heating said recording medium nipped in a nip portion formed by causing two rotating bodies to pressedly abut on each other, and conveying said recording medium by rotating said rotating bodies;

a motor that rotationally drives said two rotating bodies by transmitting a torque to at least any one of said rotating bodies;

a torque detector that detects said torque transmitted to said rotating body by said motor;

a speed detector that detects a conveyance speed for conveying said recording medium by said fixer; and a controller that corrects said detected torque on the basis of said conveyance speed by multiplying said detected torque by a coefficient corresponding to said conveyance speed detected at the time of detection of said torque and predicts a life of said fixer on the basis of a corrected torque.

2. The image forming apparatus according to claim 1, wherein said controller sets said coefficient to be smaller than "1" when said detected conveyance speed is faster than a predetermined reference speed, and said controller sets said coefficient to be larger than "1" when said detected conveyance speed is slower than said reference speed.

3. The image forming apparatus according to claim 1, wherein one of said two rotating bodies is a fixing belt, the other rotating body is a pressing roller, said controller corrects said torque on the basis of a temperature of at least any one of said fixing belt and said pressing roller detected at the time of detection of said torque using said torque detector.

4. The image forming apparatus according to claim 1, wherein said controller corrects said detected torque on the basis of at least any one of said temperature and said conveyance speed detected after a warm-up operation of said fixer is terminated, and a predetermined time passes.

5. An image forming apparatus comprising:

a fixer that fixes a toner image formed on a recording medium by pressing and heating said recording medium nipped in a nip portion formed by causing two rotating bodies to pressedly abut on each other, and conveying said recording medium by rotating said rotating bodies;

a motor that rotationally drives said two rotating bodies by transmitting a torque to at least any one of said rotating bodies;

a torque detector that detects said torque transmitted to said rotating body by said motor;

a temperature detector that detects temperature of said rotating body; and a controller that corrects said detected torque on the basis of said temperature by multiplying said detected torque by a coefficient corresponding to said temperature detected at the time of detection of said torque and predicts a life of said fixer on the basis of a corrected torque.

6. The image forming apparatus according to claim 5, wherein said controller sets said coefficient to be smaller than "1" when said detected temperature is lower than a predetermined reference temperature, and said controller sets said coefficient to be larger than "1" when said detected temperature is higher than said reference temperature.

7. The image forming apparatus according to claim 1, wherein one of said two rotating bodies is a fixing belt, and the other rotating body is a pressing roller, said controller corrects said torque by multiplying said detected torque by a coefficient corresponding to a combination of said conveyance speed and said fixing belt temperature, detected at the time of detection of said torque, and further multiplying said torque by a coefficient corresponding to a combination of said fixing belt temperature and said pressing roller temperature, detected at the time of detection of said torque.

8. The image forming apparatus according to claim 1, wherein said controller corrects said torque detected when said detected temperature is within a temperature range in a specification of a life prediction condition of said image forming apparatus, and predicts a life of said fixer on the basis of said corrected torque.

9. The image forming apparatus according to claim 1, further comprising a storage unit that stores a table in which at least any one of said conveyance speed and said temperature is associated with said coefficient, wherein said controller corrects said torque by multiplying said detected torque by at least any of a coefficient corresponding to said conveyance speed detected at the time of detection of said torque, a coefficient corresponding to said temperature detected at the time of detection of said torque, and a coefficient corresponding to a combination of said conveyance speed and said temperature detected at the time of detection of said torque, on the basis of said table.

10. The image forming apparatus according to claim 1, wherein said controller calculates a running distance at which said recording medium runs by conveyance of said fixer starting from an initial use of said image forming apparatus, corrects said torque detected for each of a predetermined said running distance, calculates an approximate expression of said torque with respect to said running distance from a relationship between said running distance and said corrected torque, and predicts a life of said fixer on the basis of an increase amount of said torque with respect to said running distance, calculated from said approximate expression.

11. A non-transitory computer-readable storage medium storing a control program for an image forming apparatus, said image forming apparatus comprising:

a fixer that fixes a toner image formed on a recording medium by pressing and heating said recording medium nipped in a nip portion formed by causing two rotating bodies to pressedly abut on each other, and conveying said recording medium by rotating said rotating bodies;

a motor that rotationally drives said two rotating bodies by transmitting a torque to at least any one of said rotating bodies;

a torque detector that detects said torque transmitted to said rotating body by said motor;

a speed detector that detects a conveyance speed for conveying said recording medium by said fixer, said control program causing a computer to perform correcting said detected torque on the basis of said conveyance speed by multiplying said detected torque by a coefficient corresponding to said conveyance speed detected at the time of detection of said torque and to perform predicting a life of said fixer on the basis of said corrected torque.

12. The image forming apparatus according to claim 1, wherein the life of said fixer indicates a replacement time before expiration of the life of said fixer.

13. The image forming apparatus according to claim 1, wherein a pad contacts an inner surface of one of the two rotating bodies, and the life of said fixer is dependent on a replacement time before expiration of a life of said pad.

14. A non-transitory computer-readable storage medium storing a control program for an image forming apparatus, said image forming apparatus comprising:

a fixer that fixes a toner image formed on a recording medium by pressing and heating said recording medium nipped in a nip portion formed by causing two rotating bodies to pressedly abut on each other, and conveying said recording medium by rotating said rotating bodies;

a motor that rotationally drives said two rotating bodies by transmitting a torque to at least any one of said rotating bodies;

a torque detector that detects said torque transmitted to said rotating body by said motor;

a temperature detector that detects temperature of said rotating body; and said control program causing a computer to perform correcting said detected torque on the basis of said temperature by multiplying said detected torque by a coefficient corresponding to said temperature detected at the time of detection of said torque and to perform predicting a life of said fixer on the basis of said corrected torque.

* * * * *